US010273960B2

(12) United States Patent
Köppler

(10) Patent No.: US 10,273,960 B2
(45) Date of Patent: Apr. 30, 2019

(54) IMPELLER FOR A SIDE CHANNEL FLOW MACHINE IN PARTICULAR DESIGNED AS A SIDE CHANNEL BLOWER

(71) Applicant: CONTINENTAL AUTOMOTIVE GmbH, Hannover (DE)

(72) Inventor: Peter Köppler, Bad Vilbel (DE)

(73) Assignee: Continental Automotive GmbH, Hannover (DE)

( * ) Notice: Subject to any disclaimer, the term of this patent is extended or adjusted under 35 U.S.C. 154(b) by 340 days.

(21) Appl. No.: 15/029,205

(22) PCT Filed: Oct. 13, 2014

(86) PCT No.: PCT/EP2014/071856
§ 371 (c)(1),
(2) Date: Apr. 13, 2016

(87) PCT Pub. No.: WO2015/055565
PCT Pub. Date: Apr. 23, 2015

(65) Prior Publication Data

US 2016/0258436 A1 Sep. 8, 2016

(30) Foreign Application Priority Data

Oct. 14, 2013 (DE) ..... 10 2013 220 668

(51) Int. Cl.
*F04D 17/10* (2006.01)
*F04D 29/26* (2006.01)
(Continued)

(52) U.S. Cl.
CPC ..... *F04D 17/10* (2013.01); *F04D 5/002* (2013.01); *F04D 23/008* (2013.01); *F04D 25/06* (2013.01); *F04D 29/188* (2013.01); *F04D 29/26* (2013.01)

(58) Field of Classification Search
CPC ..... F04D 17/10; F04D 5/002; F04D 23/008; F04D 25/06; F04D 29/188; F04D 29/26
See application file for complete search history.

(56) References Cited

U.S. PATENT DOCUMENTS 5,395,210 A * 3/1995 Yamazaki ..... F04D 23/008 415/55.1
5,407,318 A * 4/1995 Ito ..... F04D 5/002 415/55.1

(Continued)

FOREIGN PATENT DOCUMENTS

CN 101725561 6/2010
CN 101849110 9/2010

(Continued)

OTHER PUBLICATIONS

Office Action dated Feb. 28, 2017 which issued in the corresponding Chinese Patent Application No. 201480056107.6.

*Primary Examiner* — David E Sosnowski
*Assistant Examiner* — Eric J Zamora Alvarez
(74) *Attorney, Agent, or Firm* — Cozen O'Connor

(57) ABSTRACT

An impeller for a side channel flow machine has impeller blades. An inlet region of the impeller blade is off-set from the outlet region. The inlet region is connected to the outlet region via a sloped transition region. The impeller allows a high degree of efficiency of the side channel flow machine and can be produced at particularly low cost.

11 Claims, 1 Drawing Sheet

(51) Int. Cl.

| | |
|---|---|
| ***F04D 25/06*** | (2006.01) |
| ***F04D 5/00*** | (2006.01) |
| ***F04D 29/18*** | (2006.01) |
| ***F04D 23/00*** | (2006.01) |

(56) References Cited

U.S. PATENT DOCUMENTS

| | | | | |
|---|---|---|---|---|
| 5,807,068 | A * | 9/1998 | Dobler | F04D 29/188 415/55.1 |
| 6,638,009 | B2 * | 10/2003 | Honma | F04D 29/188 415/55.1 |
| 6,641,361 | B2 * | 11/2003 | Yu | F04D 29/188 415/55.1 |
| 6,932,562 | B2 * | 8/2005 | Ross | F04D 5/005 415/55.1 |
| 7,264,440 | B2 * | 9/2007 | Ikeya | F02M 37/08 415/55.5 |
| 8,070,417 | B2 * | 12/2011 | Ikeya | F04D 29/188 415/55.1 |
| 2004/0136823 | A1 * | 7/2004 | Baek | F01D 1/12 415/55.1 |
| 2004/0165981 | A1 * | 8/2004 | Iijima | F04D 29/188 415/55.1 |
| 2008/0193297 | A1 | 8/2008 | Yildirim et al. | |
| 2013/0266434 | A1 * | 10/2013 | Blackburn | F04D 23/008 415/208.1 |

FOREIGN PATENT DOCUMENTS

| | | |
|---|---|---|
| DE | 3115627 | 11/1982 |
| DE | 3801203 | 8/1989 |
| DE | 10 2005 025132 | 12/2006 |
| EP | 0 383 238 | 8/1990 |
| EP | 0 506 974 | 10/1992 |
| FR | 954916 | 1/1950 |
| WO | WO 2010/052044 | 5/2010 |

* cited by examiner

IMPELLER FOR A SIDE CHANNEL FLOW MACHINE IN PARTICULAR DESIGNED AS A SIDE CHANNEL BLOWER

CROSS REFERENCE TO RELATED APPLICATIONS

This is a U.S. national stage of application No. PCT/EP2014/071856 filed on Oct. 13, 2014. Priority is claimed on German Application No. DE 10 2013 220 668.2, filed Oct. 14, 2013, the content of which is incorporated here by reference.

BACKGROUND OF THE INVENTION

1. Field of the Invention

The invention relates to an impeller for a side channel continuous flow machine configured as a side channel blower. The impeller has a ring of impeller blades that delimit blade chambers in at least one of its end sides, the impeller blades in each case have a radially inner inlet region and a radially outer outlet region in a plan view of the end side of the impeller, and the impeller blades are inclined differently in each case in the inlet region and in the outlet region.

2. Description of the Prior Art

Side channel continuous flow machines are frequently used in motor vehicles for delivering fuel or for extracting gases and are known from practice. In the case of the impeller, which is known for a side channel blower, the impeller blades are curved and are inclined in the rotational direction. Three-dimensionally curved impeller blades are known from practice. The shaping of the impeller blades contributes significantly to the degree of efficiency achieved by way of the side channel continuous flow machine. A disadvantage of the known impellers is that three-dimensionally curved impeller blades can be manufactured only with great difficulty. This disadvantage is particularly serious, however, particularly in the case of components for motor vehicles because there is the desire for particularly simple manufacturing technology in large scale production.

SUMMARY OF THE INVENTION

One aspect of the invention is based on designing an impeller of the type mentioned at the outset such that it makes a high degree of efficiency of the side channel continuous flow machine possible and can be manufactured particularly simply.

According to one aspect of the invention, the problem is solved by virtue of the fact that those edges of the impeller blades that adjoin the end side of the impeller have sections that are offset with respect to one another in the inlet region and in the outlet region, and that the inlet region and the outlet region are connected to one another via an inclined transition region.

As a result of the design, the impeller blades are divided into different sections. The sections have a shape that can be manufactured simply. Shapes of this type can be produced inexpensively from plastic using an injection molding process by molds, which can be demolded simply. Furthermore, the sections for the respective function can be manufactured in the inlet region and in the outlet region for as high a degree of efficiency as possible. The impeller according to one aspect of the invention therefore makes it possible to produce a particularly high degree of efficiency of the side channel continuous flow machine with low manufacturing outlay.

Those sections of the impeller blades that are offset with respect to one another and their inclined transition region might extend as far as the bottom of the blade chambers. According to another advantageous development of the invention, however, a flow along the bottom of the blade chamber is configured without eddies if the end of the impeller blades which faces away from the end side has a continuous circular arc. As a result of said design, the impeller blades are at different angles with respect to the orthogonal projection of the end side of the impeller in the inlet region and in the outlet region.

According to another advantageous development of the invention, a contribution is made to increasing the degree of efficiency of the continuous flow machine which is equipped with the impeller if the inlet region is inclined to a more pronounced extent in the rotational direction of the impeller than the outlet region.

According to another advantageous development of the invention, the impeller can be demolded particularly simply if the impeller blades are of in each case planar or virtually planar design in the inlet region and in the outlet region.

According to one advantageous development of the invention, inlet and outlet regions of virtually planar design can be determined in a mathematically simple manner if the edge of the impeller blades that adjoin the end side of the impeller describes the shape of a hyperbolic tangent function. This contributes to the further reduction in the manufacturing costs of the impeller.

According to another advantageous development of the invention, a contribution is made to further simplifying the manufacturing of the impeller if the edge of the impeller blades which adjoins the end side has the same wall thickness over the entire length.

BRIEF DESCRIPTION OF THE DRAWINGS

The impeller blades might, for example, be inclined in the circumferential direction of the impeller as in the prior art. According to another advantageous development of the invention, however, a contribution is made to further simplifying the manufacturing of the impeller if the edge of the impeller blades which adjoins the end side points toward the center of the impeller in the inlet region and in the outlet region.

The invention allows numerous embodiments. For further clarification of its fundamental principle, one of them is shown in the drawing and will be described in the following text. In the drawings.

DETAILED DESCRIPTION OF THE PRESENTLY PREFERRED EMBODIMENTS

Figure 1:
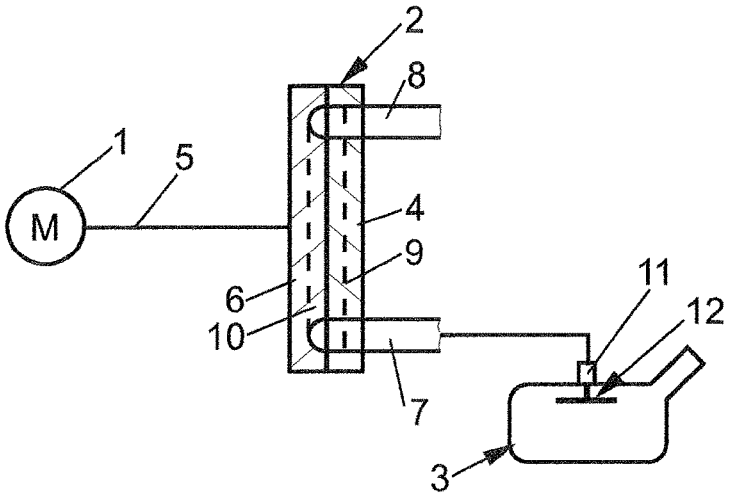
FIG. 1 diagrammatically shows a side channel continuous flow machine for extracting gases of a vent.

FIG. 1 diagrammatically shows a side channel continuous flow machine 2 driven by an electric motor 1 for extracting gases from a fuel vessel 3. The continuous flow machine 2 has an impeller 6 arranged rotatably in front of a housing wall 4 and is fastened on a shaft 5 of the electric motor 1. The housing wall 4 has an inlet duct 7 and an outlet duct 8.

In order to simplify the drawing, the inlet duct 7 and the outlet duct 8 are shown such that they are turned into the plane of the drawing. A partially annular duct 9 is arranged in the housing wall 4. The partially annular duct 9 extends from the inlet duct 7 as far as the outlet duct 8. The impeller 6 has a ring of blade chambers 10 in a manner that lies opposite the partially annular duct 9. The blade chambers 10 will be explained in greater detail with respect to FIG. 2. The inlet duct 7 is connected to an activated carbon filter 11 arranged on the fuel vessel 3. As a result, gases accumulated in the activated carbon filter 11 can be extracted by the side channel continuous flow machine 2. In an alternative embodiment (not shown), the side channel continuous flow machine 2 and the activated carbon filter 11 can also be arranged in such a way that the gases are blown out of the activated carbon filter 11. The activated carbon filter 11 is part of a ventilating device 12 of the fuel vessel 3.

Figure 2:
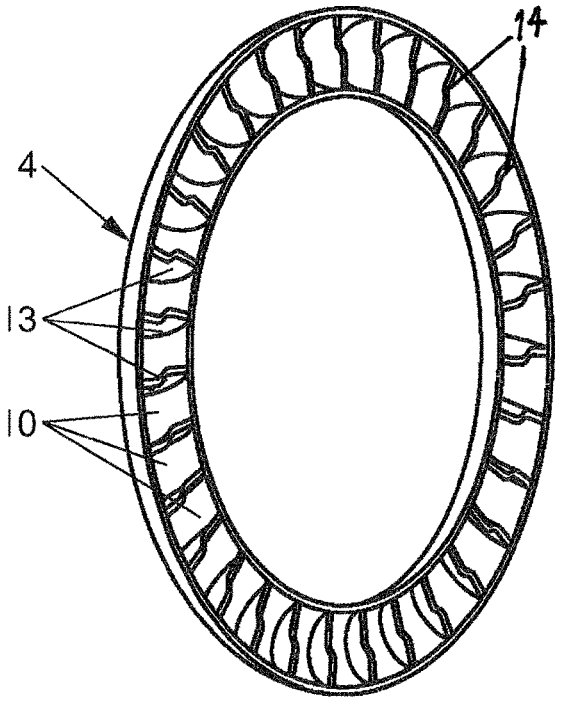
FIG. 2 prospectively shows a part region of an impeller of the side channel continuous flow machine from FIG. 1.
Figure 2A:
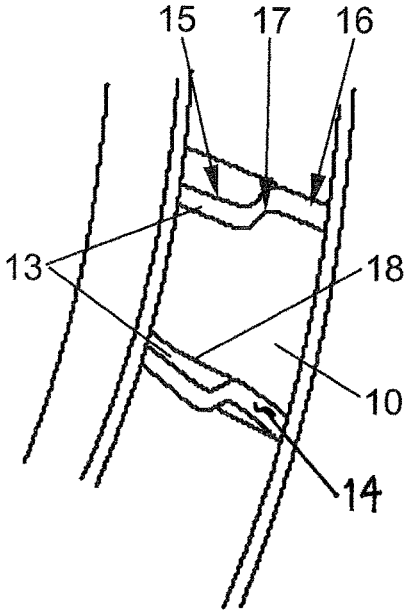
FIG. 2*a* is a blade chamber of the impeller from FIG. 2 on a greatly enlarged scale.

FIG. 2 shows, on an enlarged scale, a part region of the impeller 4 from FIG. 1, which part region has the ring of blade chambers 10. It can be seen here that the blade chambers are delimited by impeller blades 13. For clarification, FIG. 2*a* shows one of the blade chambers 10 with two impeller blades 13 on a greatly enlarged scale. The impeller blades 13 in each case have an edge 14 that terminates with the end side of the impeller 4, with a radially inner inlet region 15 and a radially outer outlet region 16. The inlet region 15 and the outlet region 16 are arranged offset with respect to one another and are connected to one another via an inclined transition region 17. In a plan view of the impeller 6, the edge 14, which adjoins the end side, has the shape of a hyperbolic tangent function. That end of the edge 14 that faces away from the end side has a continuous circular arc 18. As a result, the impeller blades 13 are inclined to a differently pronounced extent with respect to the rotational direction of the impeller 4 in the inlet region 15 and in the outlet region 16. Furthermore, FIG. 2 shows that the edge 14 of the impeller blades 13 which adjoins the end side points into the center of the impeller 4 with the inlet regions 15 and the outlet regions 16.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An impeller for a side channel continuous flow machine comprising:

a ring of impeller blades that delimit blade chambers, in at least one of the impeller's end sides, the impeller blades each having a radially inner inlet region and a radially outer outlet region in a plan view of an end side of the impeller, the impeller blades being inclined differently in the radially inner inlet region and in the radially outer outlet region, wherein respective edges of the impeller blades that adjoin the end side of the impeller have sections that are offset with respect to one another in the radially inner inlet region and in the radially outer outlet region, and in that the radially inner inlet region and the radially outer outlet region are connected to one another via an inclined transition region, wherein an end of each of the impeller blades that faces away from the impeller's end side has a continuous circular arc that extends entirely from the radially outer outlet region to the radially inner inlet region.

2. The impeller as claimed in claim 1, wherein the radially inner inlet region is inclined more in a rotational direction of the impeller than the radially outer outlet region.

3. The impeller as claimed in claim 2, wherein the impeller blades are substantially planar in the radially inner inlet region and in the radially outer outlet region.

4. The impeller as claimed in claim 3, wherein the respective edges of the impeller blades that adjoin the end side of the impeller resembles a shape of a hyperbolic tangent function.

5. The impeller as claimed in claim 4, wherein the respective edges of the impeller blades that adjoin the end side has a same wall thickness over an entire length of the respective edge.

6. The impeller as claimed in claim 5, wherein at least a portion of the respective edges of the impeller blades that adjoins the end side point toward a center of the impeller.

7. The impeller as claimed in claim 1, wherein the impeller blades are substantially planar in the radially inner inlet region and in the radially outer outlet region.

8. The impeller as claimed in claim 1, wherein each respective edge of the impeller blades that adjoins the end side of the impeller resembles a shape of a hyperbolic tangent function.

9. The impeller as claimed in claim 1, wherein the respective edge of the impeller blades that adjoins the end side has a same wall thickness over an entire length of the respective edge.

10. The impeller as claimed in claim 1, wherein at least a portion of the respective edges of the impeller blades that adjoins the end side point toward a center of the impeller.

11. The impeller as claimed in claim 1, wherein the side channel continuous flow machine is a side channel blower.

* * * * *